United States Patent [19]

Lutz

[11] 4,417,519

[45] Nov. 29, 1983

[54] EXPLOSIVE SWITCH

[75] Inventor: Harry O. Lutz, Cocoa Beach, Fla.

[73] Assignee: McDonnell Douglas Corporation, Long Beach, Calif.

[21] Appl. No.: 270,508

[22] Filed: Jun. 4, 1981

[51] Int. Cl.[3] ..... F42C 15/40

[52] U.S. Cl. ..... 102/263; 200/61.08

[58] Field of Search ..... 102/262, 263, 216; 200/61.08

[56] References Cited

U.S. PATENT DOCUMENTS

| | | | |
|---|---|---|---|
| 2,931,874 | 4/1960 | Leaman | 200/61.08 |
| 3,155,800 | 11/1964 | Denton | 200/61.08 |
| 3,601,057 | 8/1971 | Kline | 102/263 |
| 3,698,323 | 10/1972 | Apstein et al. | 102/262 |
| 3,794,794 | 2/1974 | Provancher | 200/61.08 |
| 4,150,266 | 4/1979 | Patrichi | 200/82 R |

*Primary Examiner*—Charles T. Jordan
*Assistant Examiner*—Ted L. Parr
*Attorney, Agent, or Firm*—George W. Finch; John P. Scholl; Donald L. Royer

[57] ABSTRACT

An extremely fast operating, explosive operated, switch wherein a torus supports and insulates the facing ends of flat wires of the open circuit to be closed. An explosive input is applied to a conducting piston swage member which normally is insulated from the flat wires by the torus. This moves the swage portion of the member into the torus which forces it off of the ends of the wire. The swage portion then closes the circuit by jamming the frustro-conical swage surface thereof into both flat wires.

10 Claims, 5 Drawing Figures

EXPLOSIVE SWITCH

BACKGROUND OF THE INVENTION

In conventional warheads there is need for an extremely fast operating explosively operated switch to perform in the arming system of the warhead. These switches need only operate once from a normally open position to a closed position but must do so in 10 microseconds or less with almost absolute reliability even though being subjected to high G-forces just before, and perhaps during, operation as well as adverse environmental conditions prior to firing. Heretofore, it has been difficult to find a switch that could operate in less than 10 microseconds, be capable of withstanding the rigorous environment of a warhead switch and still be relatively easy to manufacture, economical to produce and extremely reliable.

SUMMARY OF THE INVENTION

The present invention provides a switch for providing a conducting pathway extremely quickly between two portions of an electrical circuit employing flat wire. The switch includes a case having an insulated portion which assures that the normally open condition of the switch is maintained as desired. The flat wires extend through the insulation of the case into a cylindrical chamber where a portion of each extends into the side of a toroidal insulating button. The button is supported on the ends of the wires through contact therewith and through contact with an insulated plunger positioned centrally within the button. The plunger forms a portion of a circuit closing member which also includes a piston portion and a swage portion. The piston portion is mounted in the cylindrical chamber into which explosive energy is introduced to the piston portion. The explosive energy applied from the proper side pushes the circuit closing member toward the button and the swage portion which is frustro-conical shaped forces the button off the ends of the wire and shortly thereafter swages itself between the two wires. Since the swage portion is conductive, it completes the circuit. The swaging action assures that the circuit closing member remains in position to maintain the closed circuit. The amount of swaging action is restricted by an abutment surface in the case which engages the end of the plunger to prevent more than a predetermined amount of movement of the circuit closing member.

Therefore it is an object of the present invention to provide a fast acting explosive switch which can withstand the environmental rigors to which a warhead is subjected.

Another object is to provide a fast acting, explosive, normally open switch which is extremely reliable.

Another object is to provide an explosive switch which can be constructed from readily available materials at a relatively low cost.

These and other objects and advantages of the present invention will become apparent to those skilled in the art after considering the following detailed specification which covers the preferred embodiment thereof in conjunction with the accompanying drawings, wherein:

DETAILED DESCRIPTION OF THE SHOWN EMBODIMENT

Figure 1:
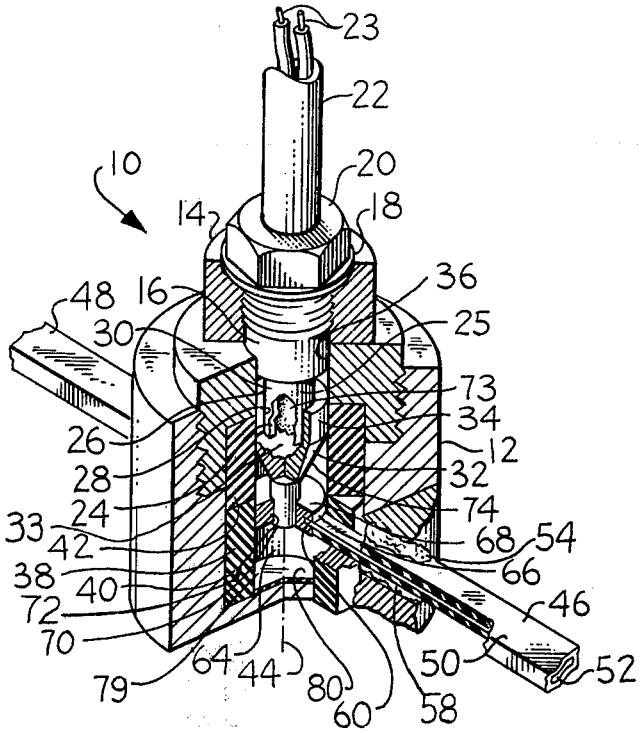
FIG. 1 is a partial cross-sectional perspective view of a switch constructed according to the present invention.

Referring to the drawings, more particularly by reference numbers, number 10 in FIG. 1 refers to a switch constructed according to the present invention. The switch 10 includes a lower cylindrical case 12 into which an upper case cover 14 is threadably connected. The upper case cover 14 has a threaded opening for engagement with a squib 16 which is threaded therein and sealed thereto by means of a washer 18 and a nut 20. The washer 18 and the nut 20 surround a shield 22 for wires 23 used to provide electrical current for firing of the squib 16. The lower end 24 of the squib 16 includes a downwardly extending cylindrically shaped portion in the form of a fixed piston 25. The outer cylindrical surface 26 thereof is predeterminately sized to mate with a bore 28 defined by an inner cylindrical surface 30 of a circuit closing member 32 constructed from a conducting material such as copper. As shown in FIG. 1, the chamber 33 formed between the bore 28 and the piston 25 is of minimum volume initially. This is to reduce time delays in the introduction therein of explosive gas pressure used to activate the switch 10. The member 32 also includes an outer cylindrical surface 34 which is predeterminately sized to slide on the inner cylindrical bore surface 36 of the case 12. A portion of the surface 36 is formed by a toroidal insulative insert 38 which may be formed in two pieces 40 and 42 as shown. In response to pressurized gas introduced between the stationary piston 25 and the member 32 by the squib 16, the member 32 is forced downwardly along the axis 44 of the bore surface 36.

The conductors 46 and 48 to be connected to electrically close the switch 10 are constructed of flat wire having an insulative coating 50 and a conductive center 52 formed with a rectangular cross-section. Orifices 54 and 56 (FIG. 2) are provided through the case 12 and the insert 38 and the conductors 46 and 48 extend therethrough respectively. Suitable potting material 58 is also placed about each conductor as it passes through the case 12 to fix the conductors 46 and 48 with respect to the central bore 36 of the switch 10. End portions 60 and 62 of the conductors 46 and 48 extend through the insulative insert 38 into a cavity 64 defined in part by the central bore surface 36 of the switch 10. The end portions 60 and 62 extend into the side surface 66 of a toroid shaped insulative button 68 to retain the button 68 prior to actuation of the switch 10. In this condition, the two conductors 46 and 48 are insulated from each other and provide an open circuit. A cylindrical pin portion 70 of the member 32 extends through a central bore 72 of the button 68 and normally assists in stabilizing the position of the button 68 on the bore surface 36.

Figure 2:
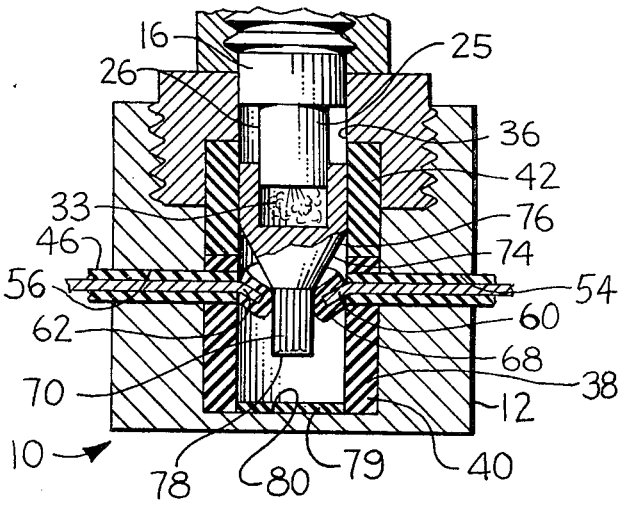
FIG. 2 is a cross-sectional view taken of the switch of FIG. 1 shortly after the switch has been explosively activated.
Figure 3:
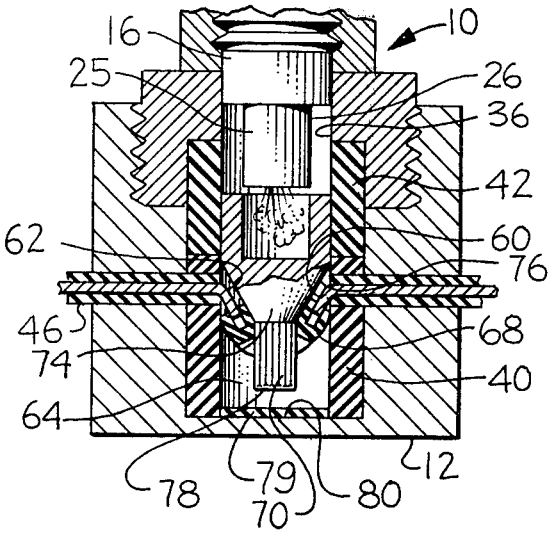
FIG. 3 is a view similar to FIG. 2 a moment in time thereafter, wherein the insulating toroidal button has been removed from the wire ends.
Figure 4:
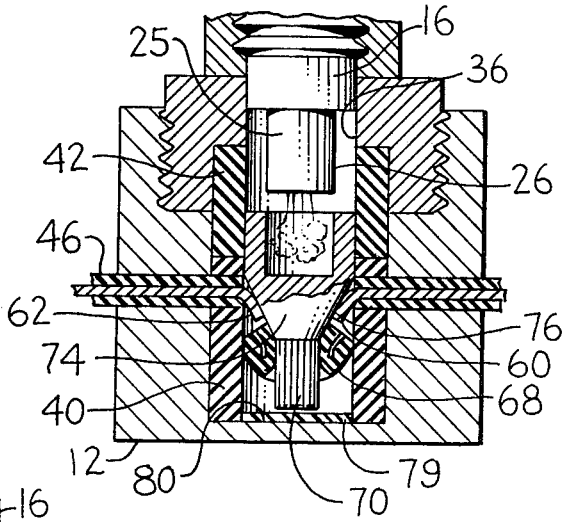
FIG. 4 is a view similar to FIGS. 2 and 3 at a still later point in the actuation cycle wherein initial electrical contact is established.
Figure 5:
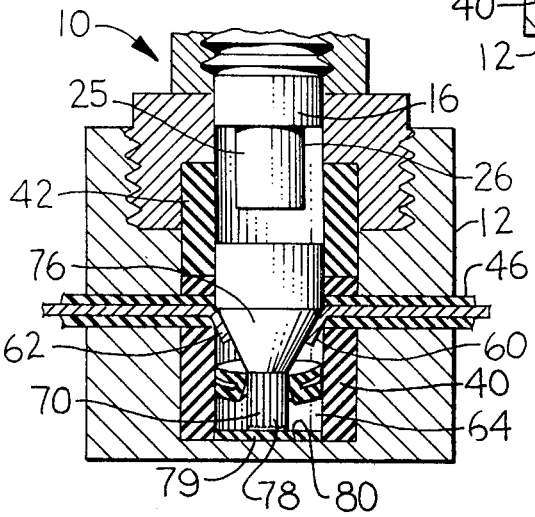
FIG. 5 is a cross-sectional view similar to FIGS. 2, 3 and 4 with the switch in its final closed condition.

When explosive 73 within the squib 16 fires, the circuit closing member 32 slides downwardly, with the pin 70 sliding downwardly through the button 68 until a frustro-conical surface 74 positioned between the pin 70 and the outer cylindrical surface 34 thereof engages the button 68, as shown in FIG. 2. Upon engagement, the frustro-conical surface 74 deforms the button 68 and removes it from the ends 60 and 62 of the conductors 46 and 48. This is shown in FIG. 3. The bare conductor ends 60 and 62 are thereby exposed for contact with the upper portion 76 of the frustro-conical surface 74 which tends to bend them downwardly as shown in FIG. 4. This process continues until the bottom 78 of the pin 70 strikes an insulator 79 at the bottom surface 80 of the case 12 which restricts further motion thereof downwardly within the cavity 64. In the alternative, the pin 70 can have an insulated end. Without some sort of insulation, the pin 70 would short the conductors 46 and 48 to the lower case 12. The length of the pin 70, and the shaping of the frustro-conical surface 74 are carefully predetermined to swedge the conductor ends 60 and 62 against the member 32. When the switch 10 reaches the position shown in FIG. 5, the circuit closing member 32 is jammed between the conductor ends 60 and 62 to provide electrical continuity therebetween. At the same time, the member 32 is mechanically fixed by the binding action inherent in the swaging action.

When suitable squibs are employed, switches such as switch 10 can be actuated for extremely fast operation such as in less than 10 microseconds. Since the parts count is low, the actuation member also being the conductor within the switch 10 to establish the final closed position thereof, the switch 10 is inherently reliable. The switch 10 also can be used in any position even though shown and described in a vertical orientation hereinbefore. This is because the button 68 is formed from insulative material, usually plastic, which is strong enough to prevent movement of the member 32 to any position where it can cause electrical continuity between the conductors 46 and 48 unless explosively moved.

Thus there has been shown and described a novel explosive switch which is reliable, fast-acting and relatively economical to construct which fulfills all of the objects and advantages sought therefore. Many changes, alterations, modifications and other uses and applications of the subject switch will become apparent to those skilled in the art after considering this specification together with the accompanying drawings. All such changes, alterations and modifications which do not depart from the spirit and scope of the invention are deemed to be covered by the invention which is limited only by the claims which follows.

I claim:

1. A fast operating, normally open single actuation switch including:

a body defining a chamber therein having first and second end portions with a central portion therebetween;

means to supply pressurized medium into said first end portion of said chamber;

at least two electrical conductors having end portions constructed from flat wire extending into said central portion of said chamber;

swaging means adapted for movement in said chamber positioned in said chamber between said means to supply pressurized medium and said at least two electrical conductor end portions; and means for releasably retaining said swaging means in position between said means to supply pressurized medium and said end portions of said at least two electrical conductor end portions until said means to supply pressurized medium does so to force said swaging means into said end portions of said at least two electrical conductors to complete an electrical circuit therebetween including:

a toroidal member having:

an inner surface; and an outer surface, said outer surface including:

a ring shaped slot in which said end portions of said at least two conductors are positioned, said swaging means including a swaging member having first and second end portions and a conductive central wedge portion therebetween, said first end portion being shaped to slide along said chamber central portion, said second end portion being adapted to engage said means for releasably retaining said swaging means by extending through said toroidal member for support thereby, and said central wedge portion being adapted to swage into said end portions of said at least two electrical conductors to complete an electrical circuit therebetween, said swaging member central portion being frustro-conical in shape having a large diameter end and a small diameter end, said swaging member first end portion being cylindrical in shape and connecting to said large diameter end of said swaging member central portion.

2. The switch as defined in claim 1 wherein said means to supply pressurized medium into said first end portion of said chamber include an electrically actuated explosive squib.

3. The switch as defined in claim 2 wherein said electrically actuated explosive squib includes a stationary piston, said swaging means including a first portion which has an interior cylindrical surface sized and positioned to mate with said stationary piston and to form an actuation chamber therebetween, said electrically actuated explosive squib discharging pressurized gas into said actuation chamber when actuated to force said swaging means into contact with said end portions of said at least two conductors.

4. The switch as defined in claim 1 wherein said body includes:

an insulated cylindrical wall defining said chamber, said swaging member central wedge portion squeezing said end portions of said at least two electrical conductors between said insulated cylindrical wall and said central wedge portion when completing an electrical circuit therebetween.

5. The switch as defined in claim 4 wherein said swaging member includes an abutment surface and said chamber lower portion includes an abutment surface positioned to abut said abutment surface of said swaging member and thereby restrict the movement thereof when said means to supply pressurized medium into said first end portion of said chamber does so to control the squeezing of said end portions of said at least two electrical conductors.

6. The switch as defined in claim 1 wherein said swaging member including said central wedge portion and said first and second end portions is comprised of a unitary conductor.

7. The switch as defined in claim 6 wherein said chamber includes an electrically insulated cylindrical side wall sized to mate with said swaging member first end portion and along which said swaging member first end portion slides.

8. The switch as defined in claim 7 wherein said swaging means second end portion includes an abutment surface and said chamber lower portion includes an electrically insulated abutment surface positioned to abut said abutment surface of said swaging means second end portion and thereby restrict the movement of said swaging means when said means to supply pressurized medium into said first end portion of said chamber does so.

9. A fast operating, normally open, single actuation switch including:

a body defining a chamber therein having first and second end portions with a central portion therebetween;

means to supply pressurized medium into said first end portion of said chamber;

at least two electrical conductors having end portions extending into said central portion of said chamber;

swaging means adapted for movement in said chamber positioned in said chamber between said means to supply pressurized medium and said at least two electrical conductor end portions; and means for releasably retaining said swaging means in position between said means to supply pressurized medium and said end portions of said at least two electrical conductor end portions until said means to supply pressurized medium does so to force said swaging means into said end portions of said at least two electrical conductors to complete an electrical circuit therebetween, said swaging means including a swaging member having first and second end portions and a conductive central wedge portion therebetween, said first end portion being shaped to slide along said chamber central portion, said second end portion being adapted to engage said means for releasably retaining said swaging means, and said central wedge portion being adapted to swage into said end portions of said at least two electrical conductors to complete an electrical circuit therebetween, said swaging member central portion being frustro-conical in shape having a large diameter end and a small diameter end, said swaging member first end portion being cylindrical in shape and connecting to said large diameter end of said swaging member central portion and at least said end portions of said at least two conductors being constructed from flat wire, said means for releasably retaining said swaging means including a toroidal member having an inner surface and an outer surface, said outer surface including a ring shaped slot in which said end portions of said at least two conductors are positioned prior to actuation of said switch, said swaging member lower end portion extending through said toroidal member to stabilize said toroidal member prior to actuation of said switch.

10. The switch as defined in claim 9 wherein said means to supply pressurized medium into said first end portion of said chamber include an electrically actuated explosive squib, said electrically actuated explosive squib including a stationary piston, said swaging means first end portion having an interior cylindrical surface sized and positioned to mate with said stationary piston and to form an actuation chamber therebetween, said electrically actuated explosive squib discharging pressurized gas into said actuation chamber when actuated to force said swaging means frustro-conical surface into contact with said end portions of said at least two conductors.

* * * * *